United States Patent [19]

McClain

[11] 4,059,045

[45] Nov. 22, 1977

[54] ENGINE EXHAUST RAIN CAP WITH EXTRUDED BEARING SUPPORT MEANS

[75] Inventor: Richard D. McClain, Schaumburg, Ill.

[73] Assignee: Mercury Metal Products, Inc., Schaumburg, Ill.

[21] Appl. No.: 685,513

[22] Filed: May 12, 1976

[51] Int. Cl.[2] ..... F23L 17/02

[52] U.S. Cl. ..... 98/122; 137/527.2; 251/299

[58] Field of Search ..... 98/59, 122; 251/299; 137/527.6

[56] References Cited

U.S. PATENT DOCUMENTS

| | | | |
|---|---|---|---|
| 2,983,216 | 5/1961 | Stade et al. | 98/59 |
| 3,334,932 | 8/1967 | Buresh | 98/59 |
| 3,407,720 | 10/1968 | Westerman | 98/59 |
| 3,667,260 | 6/1972 | Foote | 98/59 |
| 3,791,282 | 2/1974 | McElhose et al. | 98/59 |
| 3,964,376 | 6/1976 | Janke | 98/59 |

*Primary Examiner*—Ronald C. Capossela
*Attorney, Agent, or Firm*—Silverman & Cass, Ltd.

[57] ABSTRACT

An engine exhaust rain cap of the type which is adapted to be clamped to an upstanding exhaust pipe and including a cover secured to a corner of a balance arm body which is pivotally mounted on the ears of the clamp. The balance arm body is a folded sheet metal member whose halves have annular integral outwardly directed extrusions that are brazed to a bearing bushing which in turn is journalled on a bearing member that extends between the halves. The result is a more durable device, especially in the case of heavy duty rain caps.

3 Claims, 4 Drawing Figures

ENGINE EXHAUST RAIN CAP WITH EXTRUDED BEARING SUPPORT MEANS

BACKGROUND OF THE INVENTION

This invention is an improvement on the structure of U.S. Pat. No. 2,983,216 which is incorporated herein by reference.

Rain caps constructed in accordance with the invention were made with the sheet metal halves of the balance arm body pierced and engaged onto a bushing, usually by force fit. Welding was feasible but the engagement was edgewise. It was found that these pivotal arrangements wore out because of the continuous beating that was administered during use. The joint between the pierced holes and the bushing loosened and rendered the device ineffectual. The other parts of the device would also wear out quickly because of this. Especially this was true for large devices, as for example where the exhaust pipe or stack had a diameter of more than five inches. It can be appreciated that these devices were heavy and the inertia of large moving pieces exerted considerable shock on the bearing structure.

The invention herein is intended to solve the problem, but does so in a manner which is applicable to small sizes of rain cap as well as large.

SUMMARY OF THE INVENTION

The rain cap of the invention comprises a strap clamp adapted to be engaged upon an exhaust stack, the clamp having a pair of parallel laterally extending ears. A bolt effects the clamping action between the ear ends and the looped formation of the clamp. A rivet or bolt spaced outwardly of the loop extends between the ears and pivotally mounts the balance arm and cover, the latter two being integral with one another. The cover is a dishlike member adapted to engage upon the upper open end of the stack. The balance arm is formed of sheet metal, folded upon itself with the halves spaced apart, the halved being generally polygonal in a somewhat diamond configuration. The corner of the balance arm is welded to the cover. The halves of the arm have outwardly extruded, aligned, annular flanges which are brazed to a bushing which in turn is journalled onto a sleeve-like bearing member coaxially mounted on the rivet or bolt.

BRIEF DESCRIPTION OF THE DRAWING

Referring now to the drawing wherein.

DESCRIPTION OF THE PREFERRED EMBODIMENT

Figure 1:
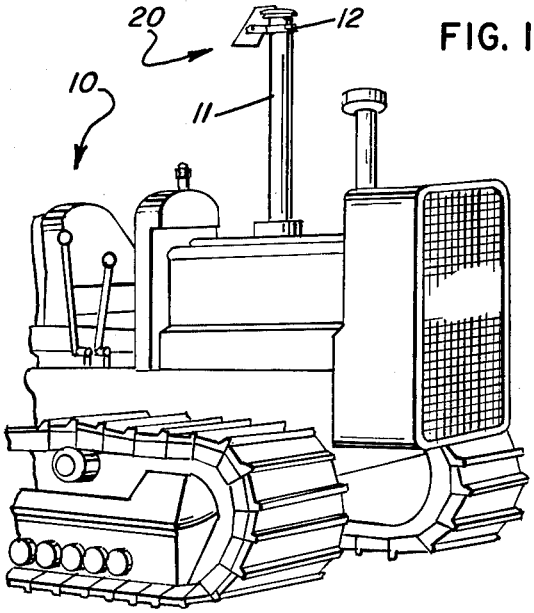
FIG. 1 is a perspective view of a tractor whereon the protective cover assembly embodying the invention is shown installed in closed position upon the upstanding exhaust conduit thereof.

As shown in FIG. 1, the rain cap 20 of the invention is adapted to be installed on an upstanding exhaust stack 11 of a heavy duty vehicle such as a tractor 10. The rain cap swings open when the engine of the vehicle is operating and the exhaust gases are being blown out of the stack. Otherwise, the weight of the cover 16 keeps the stack end covered.

The device 20 comprises a clamp 12, balance arm body 14, and cover 16 secured to one upper end corner of said balance arm body 14 by means of welded flange 18. A portion of said balance arm body extends over said cover 14 at the periphery thereof, likewise a small portion of said balance arm body extends vertically above the horizontal plane of said cover.

The clamp 12 comprises a metal band portion 22 adapted to substantially encircle the outer peripheral surface of the exhaust conduit 11, said band 22 having a pair of lateral extensions 24, each having an aperture therein to accommodate a tightening bolt 23 therethrough, said bolt to be engaged in a nut 26. In the embodiment herein described a flat-headed carriage bolt is used and one aperture is square and the other is round. Any other type of tightening screw means may be as equally applicable to bridge the distance between the two extensions 24. A pair of ears 28 and 28' is provided spaced outwardly offset from the extensions 24, and at parallel horizontal planes relative thereto. Each ear 28 and 28' is connected to an extension 24 by a bent portion 32. Each ear 28 and 28' is provided with an aperture seating therebetween the pivot means generally shown at 34. Ear 28' has an extension with an opening that can align with openings in the arm body 14 to receive the hasp of a lock to secure the device 20 upon the stack pipe 11 when the vehicle is not in use.

The balance arm body 14 comprises a pair of spaced juxtaposed polygonal plates 36 of like configuration, each of said plates 36 having generally the configuration of an irregular rectangle, the horizontal edges thereof being substantially parallel in constrast to the nonparallel vertical edges. The said member 14 is formed preferably from a single blank of steel or the like reverse bent on the fold 38. A lateral extension of the fold 38 protrudes in overlapping relation to a portion of said cover 16 spaced inward from its edge. The cover overlapping portion of fold 38 is provided with an integral outwardly extending flange member 18, said flange 18 being in surface to surface contact with the top surface of said cover 16 and is permanently secured thereto by means such as welding or the like as indicated at 41.

The pivot means 34 is utilized pivotally to support the balance arm body 14 between the ears 28 and 28' so that the cover 16 will be biased in contact with the top edge of the exhaust conduit 11 when the clamp 12 has been secured upon said conduit near the upper portion thereof but spaced from the open end to allow the overlapping cover 16 to be in contact with the top circumferential edges of said open end.

Figure 4:
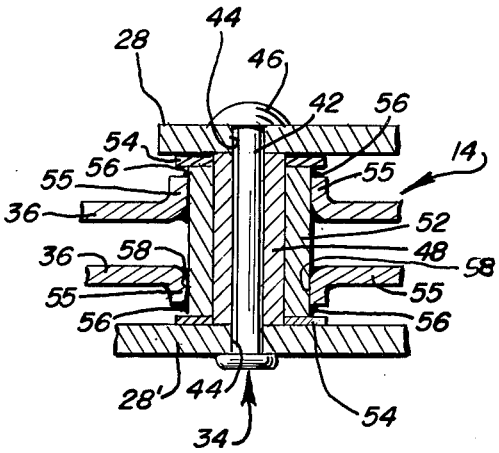
FIG. 4 is a section taken through line 4—4 of FIG. 2 and in the direction indicated.
Figure 2:
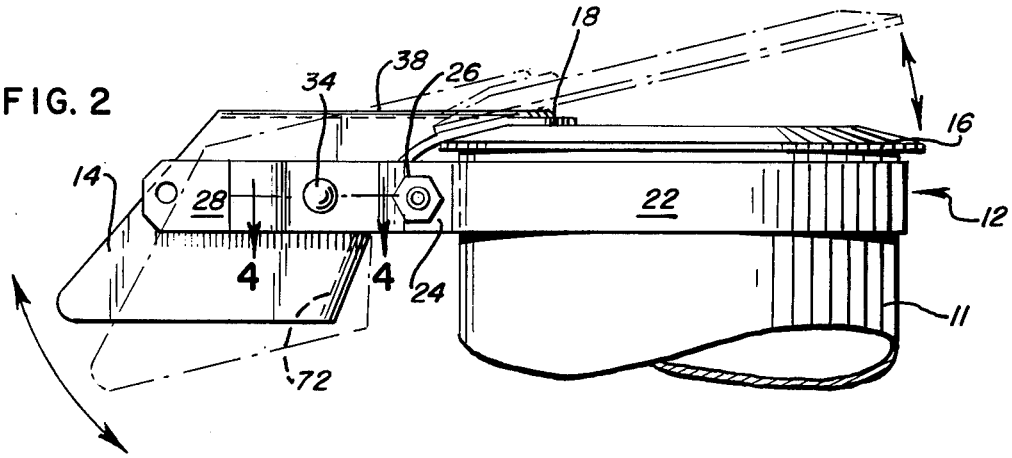
FIG. 2 is a fragmentary enlarged elevational view of said exhaust conduit shown in FIG. 1, the broken lines illustrating the cover device in partially open position.
Figure 3:
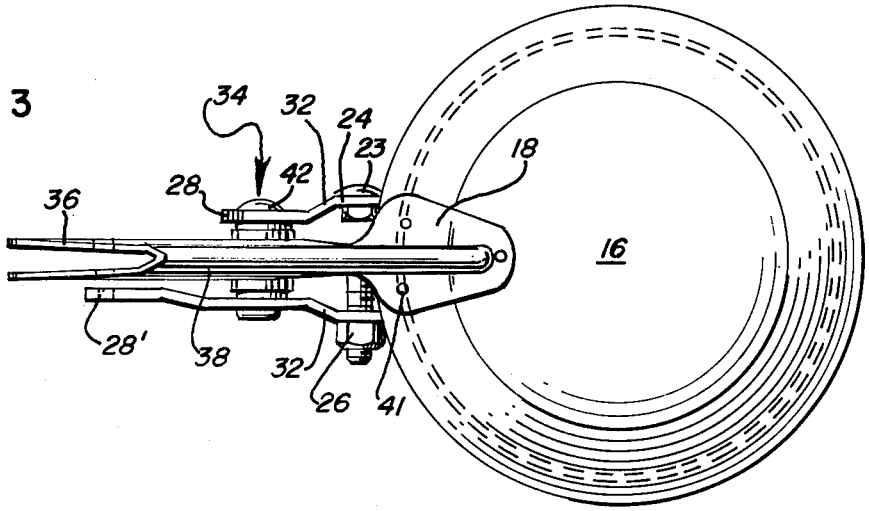
FIG. 3 is a top plan view of the protective cover device shown in FIG. 2.

Referring to FIG. 4, the pivot means 34 comprise a rivet or bolt 42 adapted to pass through the apertures 44 in the ears 28 and 28', said rivet having enlarged head ends 46 engaging the outer surfaces of the ears 28 and 28' and cooperating with the bearing member 48 through which the rivet passes to secure the ears in spaced relationship. A bushing 52 of some sintered metal for good journalling characteristics is journalled on the bearing member 48 and extends between a pair of end washers 54. The washers 54 are optional and may be formed of teflon or the like. The dimensions of the bushing 52 and the thickness of the washers 54 are chosen to enable free swinging movement of the bushing without binding.

The invention herein is principally concerned with the structure which may be called extruded bearing support means. Such means comprise integral flanges 55 which are punched or extruded from the plates 36 outwardly thereof thereby forming passageways 58. These flanges 55 must be formed while the arm 14 is still in the flat by means of suitable dies. When the halves of the arm are folded along the fold 38, the jig or fixture or die in which this is done must have recesses to receive the outwardly protruding flanges 55 to prevent distortion thereof.

In the construction of the arm 14, after the arm has been folded, the bushing 52 is engaged into the flanges 55 and brazed in place as shown at 56. The result of this operation is to secure the bushing 52 to the arm 14 in a connection which has considerable engagement area. The brazing operation will cause the brazing metal to run well into the inner cylindrical portions of the flanges 55 and thereby permanently secure the arm 14 in place.

Assembly of the device 20 is obvious. The arm 14 with its bushing 52 and the washers 54, if used, are engaged onto the bearing member 48 and the entire assembly moved between the ears 28 and 28' until the bore of the member 48 is aligned with the openings 44 at which point the rivet 42 is slipped into place and its unheaded end swaged down upon the ear it protrudes from.

For the remainder of the description of the structure of the invention reference may be had to the patent mentioned above.

What it is desired to secure by Letters Patent of the United States is:

1. In a gravity actuated protective cover device adapted to be secured upon the upstanding exhaust conduit of an internal combustion engine to prevent the entry of extraneous matter therein during the inoperative stage of said engine, said protective cover device comprising a clamp member having a looped band portion and a bracket portion integral therewith, the looped band portion adapted to substantially encircle the peripheral surface of said conduit, the bracket portion carrying means thereon for tightening said looped band portion, pivot support means carried by said bracket portion at a point spaced outwardly from said tightening means, an elongate relatively flat balance member journalled upon said pivot support means in a vertical plane relative to said clamp member, a dish-shaped cover member secured to the upper portion of said balance member and adapted when the device is installed to be seated over the mouth of said conduit in overhanging relation thereto, the point of pivot of said balance member being chosen relative to the size and weight of the balance member so that when the plane of the looped band portion is horizontal the weight of the cover member will tend to lower said cover member toward the looped band and raise the other end of the balance member, but normal pressure of exhaust gases from said internal combustion engine will tend to blow the cover off the conduit easily during operation of the engine with immediate dropping of the cover member when the engine stops, the invention herein which comprises:

the bracket portion including a pair of spaced apart ears, the balance member being straddled by said ears, the pivot support means comprising a cylindrical bearing member mounted between the ears, the balance member having an integral, laterally protruding annular flange coaxial with a passageway therethrough a cylindrical bushing, said flange being permanently fixedly secured to said cylindrical bushing, the bushing being journalled and supported upon the bearing member and limited in axial movement thereon by the spaced apart ears.

2. The invention as claimed in claim 1 in which the balance member comprises a sheet metal member formed as a pair of plates connected by a reverse fold whereby the plates are parallel one with the other and each plate has the annular flange and passageway formed therein in axial alignment, the flanges protruding outwardly relative to one another and both being permanently and fixedly secured to said cylindrical bushing.

3. The invention as claimed in claim 2 in which the pivot support means includes a shaft connected between the ears and the bearing member is hollow and telescopically engaged upon the shaft whereby to maintain the spacing between the ears.

* * * * *